US005692816A

United States Patent [19]

Lai

[11] Patent Number: 5,692,816

[45] Date of Patent: Dec. 2, 1997

[54] CABINET DRAWER GUIDE ASSEMBLIES

[76] Inventor: Pepper Y. Lai, 1305 Pepper Hill Rd., Greensboro, N.C. 27407

[21] Appl. No.: 684,570

[22] Filed: Jul. 19, 1996

Related U.S. Application Data

[63] Continuation of Ser. No. 489,479, Jun. 12, 1995, Pat. No. 5,556,182.

[51] Int. Cl.[6] ..... A47B 88/14

[52] U.S. Cl. ..... 312/334.4; 312/348.1; 312/334.19; 312/334.12

[58] Field of Search ..... 312/334.4, 348.1, 312/334.22, 334.19, 330.1, 334.7, 334.14, 334.15, 334.41, 334.1, 334.12, 334.21

[56] References Cited

U.S. PATENT DOCUMENTS

| | | | |
|---|---|---|---|
| 1,135,235 | 4/1915 | Weiss | 312/334.12 |
| 1,686,783 | 10/1928 | Wolters | 312/334.12 |
| 2,004,057 | 6/1935 | Schmitz | 312/334.12 |
| 2,139,520 | 12/1938 | Scheinman et al. | 312/334.41 |
| 2,233,906 | 3/1941 | Zalkind | 312/334.19 |
| 2,361,116 | 10/1944 | Mayer | 312/334.21 X |
| 2,594,571 | 4/1952 | Lundberg | 312/334.19 |
| 3,113,818 | 12/1963 | Armentrout et al. | 312/334.4 |
| 3,142,517 | 7/1964 | Ward | 312/334.12 X |
| 3,270,891 | 9/1966 | Briggs | 312/334.41 |
| 4,475,778 | 10/1984 | Stark | 312/334.1 |
| 4,615,572 | 10/1986 | Nelson | 312/334.4 |
| 4,732,436 | 3/1988 | Nelson | 312/334.21 X |
| 4,842,351 | 6/1989 | Rock et al. | 312/330.1 |
| 4,927,216 | 5/1990 | Boda | 312/334.12 |
| 5,449,231 | 9/1995 | Lin | 312/334.12 X |
| 5,462,349 | 10/1995 | Graher | 312/348.1 |
| 5,470,144 | 11/1995 | Wen | 312/334.44 |
| 5,474,378 | 12/1995 | Smith et al. | 312/334.4 |
| 5,490,724 | 2/1996 | Domenig | 312/334.19 X |

FOREIGN PATENT DOCUMENTS

| | | | |
|---|---|---|---|
| 448453 | 9/1991 | European Pat. Off. | 312/334.1 |
| 503234 | 9/1992 | European Pat. Off. | 312/330.1 |
| 626144 | 11/1994 | European Pat. Off. | 312/330.1 |
| 1271269 | 7/1961 | France | 312/334.21 |
| 2420307 | 3/1976 | Germany | 312/334.12 |
| 2701712 | 7/1978 | Germany | 312/334.12 |
| 2915009 | 10/1980 | Germany | 312/334.12 |
| 4139441 | 6/1992 | Germany | 312/334.7 |
| 4114708 | 11/1992 | Germany | 312/334.1 |
| 5043009 | 2/1993 | Japan | 312/334.1 |
| 1253610 | 8/1986 | U.S.S.R. | 312/334.12 |
| 493923 | 10/1938 | United Kingdom | 312/334.12 |
| 0803331 | 10/1958 | United Kingdom | 312/334.12 |
| 94/14358 | 7/1994 | WIPO | 312/334.12 |

*Primary Examiner*—Peter M. Cuomo
*Assistant Examiner*—David E. Allred

[57] ABSTRACT

A side-mounted drawer slide assembly for a cabinet or chest is provided in which elongated a wall component is engageable with a drawer component for relative movement therebetween. The slide assembly is versatile in nature in that it can be used on either the right or left sides of the drawer without the need of additional parts. The preferred form of the wall mount of the invention includes a roller which is affixed to a plate which is slidably joined for adjustable vertical movement. Other embodiments of the invention provide rollers which can be vertically adjusted and used on either the right or left sides of the drawer. Another embodiment allows the roller to be moved from one side of the wall component to the other as required.

5 Claims, 3 Drawing Sheets

CABINET DRAWER GUIDE ASSEMBLIES

This is a continuation of application Ser. No. 08/489,479 filed 12 Jun. 1995, now U.S. Pat. No. 5,556,182.

BACKGROUND OF THE INVENTION

1. Field of the Invention

The Invention described herein concerns drawer guide assemblies as used by furniture manufacturers and others and particularly pertains to drawer guide assemblies which are side mounted.

2. Description of the Prior Art and Objectives of the Invention

Side mounted drawer guide assemblies have been used for many years by furniture manufacturers, cabinet shops and others to achieve a smooth, even drawer movement as a drawer is opened and closed as commonly used for kitchen cabinets, desks, chests and other case goods. Side mounted drawer guide assemblies generally consist of engageable components sold in pairs for left and right sides of the drawer. Side mounted drawer guide assemblies are generally preferred over single bottom mounted drawer guides which oftentimes do not supply the support and stability needed and required by most consumers.

With the increased costs of materials and labor befalling the furniture industry and other trades, manufacturers are reluctant to purchase inventory in amounts above the minimum required. Thus, some manufacturers have found that during the end of a production run they may have an excess number of either left or right drawer guide assemblies, but without the matching opposite side components, manufacturing cannot be completed until restocking occurs. At other times manufacturers have found defects in either the left or right drawer guide assemblies, again having to wait until inventory is restocked for the particular cabinet manufacturing process can be complete.

Thus, with the disadvantages and problems associated with prior art side mounting drawer guide assemblies, the present invention was conceived and one of its objectives is to provide a side mounted drawer guide assembly which can be used on either the left or right side of a cabinet drawer.

It is still another objective of the present invention to provide a drawer guide assembly which is easier to install and provides a smooth, even movement for the drawer.

It is yet another objective of the present invention to provide a drawer guide assembly which can be easily interchanged and used on either the left or right sides of the drawer.

It is still another objective of the present invention to provide a drawer guide assembly which, in one embodiment, allows for vertical adjustment of a roller.

Various other objectives and advantages of the present invention will become apparent to those skilled in the art as a more detailed description is set forth below.

SUMMARY OF THE INVENTION

The invention herein pertains to side mounted drawer guide assemblies as are used in the furniture and cabinet-making industries. An elongated metal drawer component can be either tack nailed or attached with wood screws to either the left or right side of the drawer and is engageable with cabinet wall mounted components which are likewise tack nailed to the inside of the cabinet wall. Rollers allow the components to smoothly slidably engage. The wall mounted component includes in one embodiment a roller which is affixed to a bracketed, slidable plate.

In another embodiment the roller of the wall mounted component can be easily removed from an axle opening and positioned in another, vertically positioned axle opening.

In still another embodiment, a pivotal extension allows the roller to move in an arcuate, vertical path.

In yet a fourth embodiment, the fixed center roller consists of an undersized roller which can be positioned in either side of the wall component for use either on the left or right side of the cabinet wall.

BRIEF DESCRIPTION OF THE DRAWINGS

as seen in FIGS. 1 and 2.

DESCRIPTION OF THE PREFERRED EMBODIMENT

Figure 1:
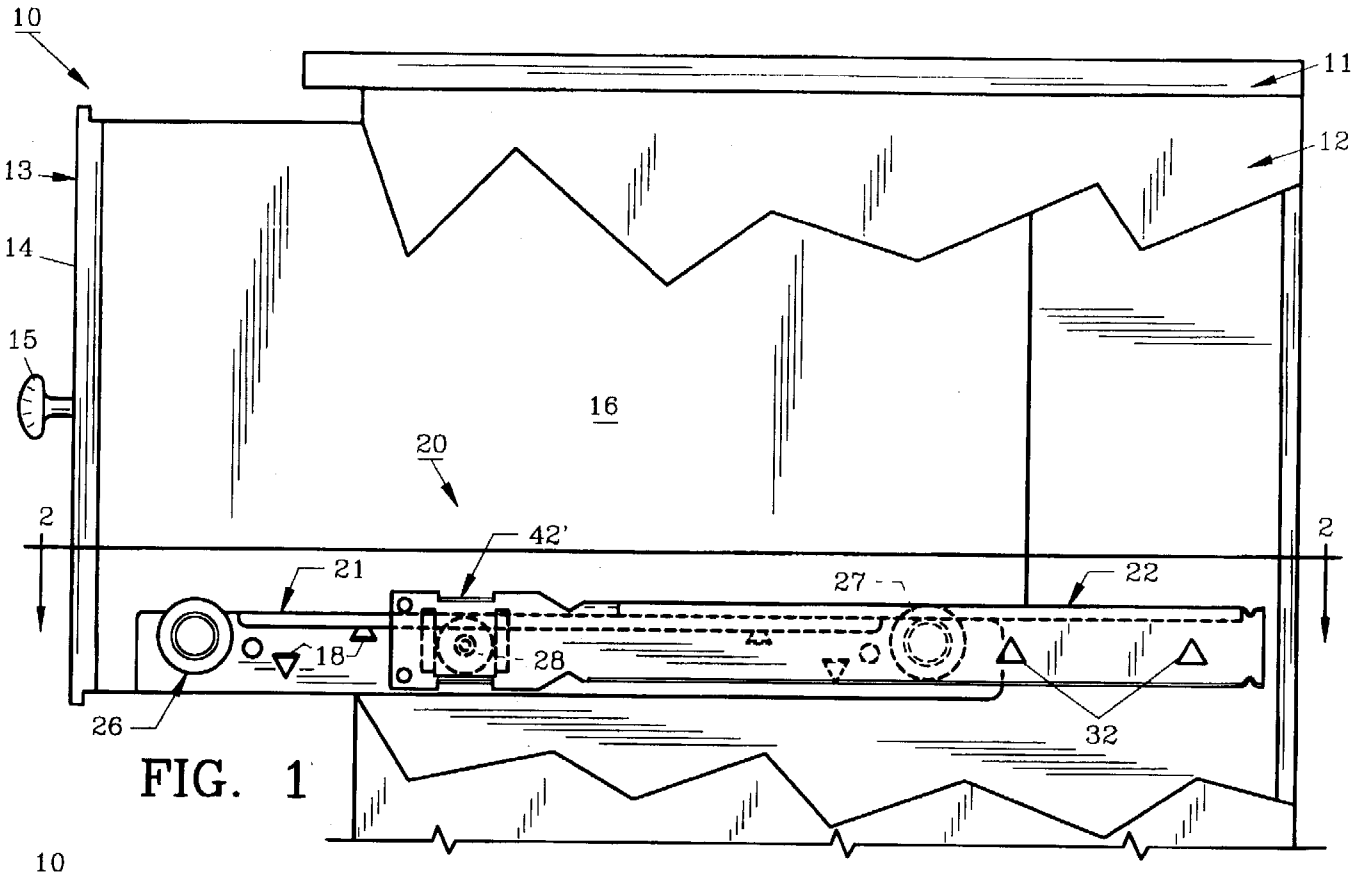
FIG. 1 demonstrates a cutaway view of a typical cabinet employing an openable drawer employing the invention herein.
Figure 2:
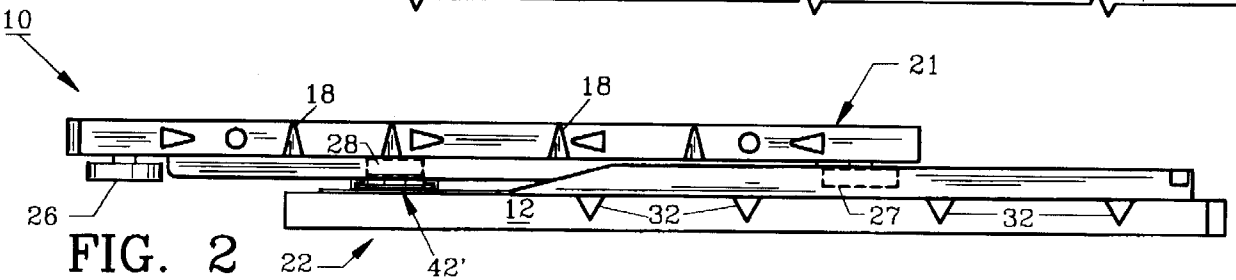
FIG. 2 pictures a top view along lines 2—2 of the invention as shown in FIG. 1.
Figures 3, 4, 5, 9, 10, 11:
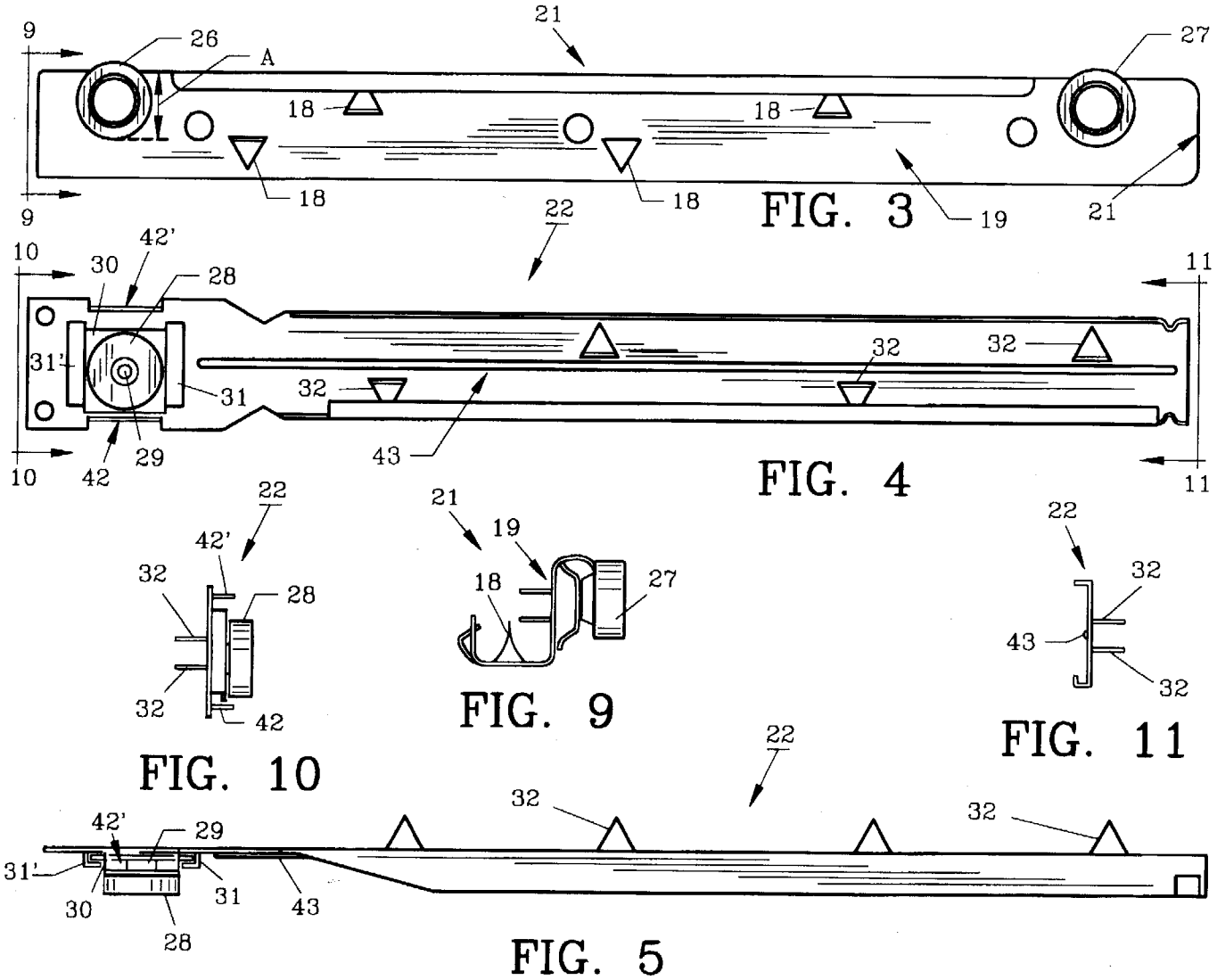
FIG. 3 illustrates a side view of the drawer component.
FIG. 4 shows a side view of the preferred cabinet wall component of the invention.
FIG. 5 demonstrates a top view of the wall component as shown in FIG. 4.
FIG. 9 depicts an end view of the drawer component along lines 9—9 of FIG. 3.
FIG. 10 presents an end view of the wall component as shown in FIG. 4 along lines 10—10.
FIG. 11 depicts an end view of the wall component as shown in FIG. 4 along lines 11—11.

The preferred form of the invention is illustrated in FIGS. 1–5 in which a drawer component is affixed with integral tack nails to the side and bottom of a conventional cabinet drawer. Engageable therewith and also affixed by tack nails to the inside cabinet wall, is an elongated wall component which engages the drawer to form the preferred cabinet drawer guide assembly of the invention. The cabinet wall component as seen in FIGS. 4, 10 and 11, comprises an elongated member having a roller at one end thereof to guide the drawer component. The roller is affixed through its axle to a slide plate which is bracketed to the elongated cabinet wall component. The brackets allow the slide plate to freely move therein whereby the wall component can be used on either the left or right side of the cabinet to provide drawer support and movement.

DETAILED DESCRIPTION OF THE DRAWINGS AND OPERATION OF THE INVENTION

For a better understanding of the invention and its use, turning now to the drawings, FIG. 1 demonstrates a fragmented side view of a typical cabinet 10 having a top 11 and a side 12 which has been cut away to reveal the contents thereof. Drawer 13 includes front 14 which has a pull knob 15 affixed thereto. Front 14 is secured to side 16, as commonly constructed in the industry. Drawer guide assembly 20 as shown has a drawer component 21, which is affixed to drawer side 16, and engages in with the preferred form, with cabinet wall component 22. Drawer guide assembly 20 is formed from metal and is preferably enamel-coated. As hereinafter explained, drawer component 21 can be used with a variety of cabinet wall component embodiments such as wall components 22–25, as seen in FIGS. 4–8.

FIG. 2 shows a view along lines 2—2 of FIG. 1 to illustrate drawer component 21 and its engaging relation to cabinet wall component 22. As would be understood, as shown in FIG. 3, drawer component 21 includes a relatively flat elongated side wall 19 having tack nails 18 formed by first cutting and then bending a triangular shape outwardly at a 90° angle to side wall 19. Drawer component front roller 26 and drawer rear roller 27 are formed from plastic and are attached to side wall 19 of drawer component 21 as shown in FIGS. 2 and 3 for cooperative engagement with wall component 22, as seen in FIGS. 1 and 2.

Cabinet wall component 22, (FIG. 1) includes roller 28, which is rotatably affixed to axle 29 (FIGS. 4, 5) which in turn is rigidly secured to planar roller plate 30. Roller plate 30 is slidable within L-shaped brackets 31, 31' which are rigidly affixed at one end of drawer component 22 and will cease movement at stops 42, or 42' described below. Slide plate 30 allows vertical adjustment of roller 28, which will permit cabinet wall component 22 to easily engage drawer component 21 and will provide a smooth and even movable action therewith. By allowing roller 28 to move vertically, as illustrated in FIG. 4, wall component 22 can be used on both the left and right sides of cabinet. drawer 13 and is completely interchangeable, since roller 28 can be adjustably positioned as needed to engage drawer support 21. Ridge 43 as seen in FIGS. 4 and 11 increases the rigidity of component 22 and provides a surface for roller 27 to move against, thus reducing the friction along the side of roller 27 as drawer 13 is opened and closed. Also, slide plate 30 will terminate its upward and downward movement as it contacts stops 42' and 42 respectively as shown in FIGS. 4 and 10.

Tack nails 32, as shown in FIGS. 4, 5, are used to conveniently and securely affix by either light hammering or assembly automation, cabinet wall component 22 to the inside surface of wall 12, as shown more clearly in FIGS. 1 and 2.

Figure 6:
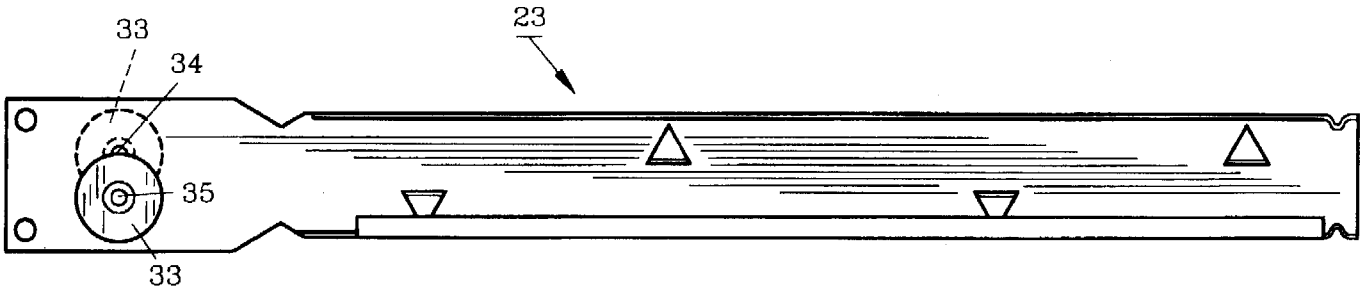
FIG. 6 illustrates another embodiment of the wall component of the invention with a plurality of vertical axle openings.

In another embodiment, as shown in FIG. 6, cabinet wall component 23 is illustrated having a removable roller 33 with an extending axle 35. Roller 33 can be placed on one side of wall component 23 at a particular vertical height, or can be removed and axle 35 inserted in opening 34 at another fixed height. Roller 33 with axle 35 is removable and can be inserted on either side in either opening with axle 35 as required, thus increasing its versatility and uses with various drawer components.

Figure 7:
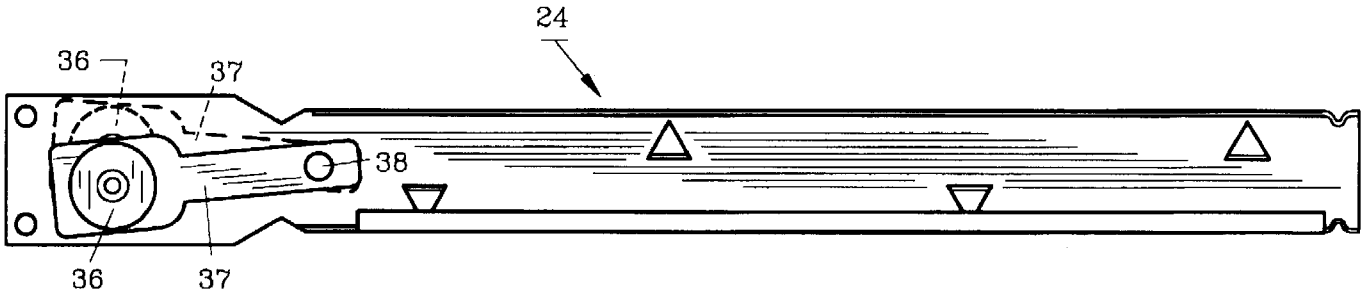
FIG. 7 provides another embodiment of the wall component of the invention illustrating a pivotal extension having a roller attached thereto.

Another example of variable vertical roller positioning is depicted in FIG. 7, whereby roller 36 is mounted on pivotal extension 37. As shown, extension 37 rotates around axle 38 to any of a variety of positions as necessary, thus allowing component 24 to likewise be positionable on either the left or right side of a cabinet drawer and to permit roller 36 to be instantly adjustable.

Figure 8:
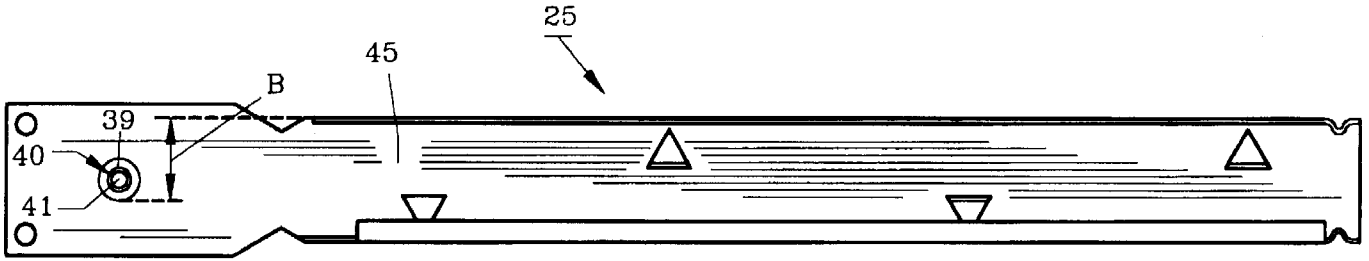
FIG. 8 shows yet another embodiment of the wall component of the invention with an undersized, fixed center roller thereon.

FIG. 8 shows yet another embodiment of a drawer wall component 25 having a fixed center or axle opening 40 for receiving axle 41 of roller 39 which is smaller than usual rollers. The diameter of roller 39 is undersized and much smaller than rollers shown in embodiments 1, 2 and 3 above (FIGS. 4–7) and is so sized to engage with a variety of drawer components, such as drawer component 21 shown herein. Cabinet wall component 39 illustrated in FIG. 8 has a distance "B" from the bottom of roller 25 to the top of elongated member 45. Distance B is the same as distance "A" shown in FIG. 3 from the bottom of roller 26 to the top of elongated side wall 19 whereby wall component 21 and cabinet wall component 28 will properly engage.

As would be understood, the concept herein is expressed in a variety of ways whereby a single cabinet wall component can be used either on the left or the right side of the drawer without having to make both left and right side components, and is engageable with a variety of drawer components. Thus, the illustrations and examples provided herein are for explanatory purposes and are not intended to limit the scope of the appended claims.

I claim:

1. A side-mounted drawer slide assembly for a cabinet having an elongated wall component engagable with an elongated drawer component for relative movement therebetween, said drawer component comprising a channel member and a pair of drawer rollers rotatably joined to opposite ends of said channel member, said channel member defining a tack nail, said tack nail for attaching said drawer component to a drawer, said wall component comprising a removable roller, said removable roller for slidably engaging said channel member.

2. The slide assembly of claim 1 wherein said wall component defines a first opening, said removable roller for insertion therein.

3. The slide assembly of claim 1 wherein said wall component defines a second opening, said removable roller for insertion therein.

4. The slide assembly of claim 1 wherein said wall component comprises an elongated U-shaped channel member, said U-shaped channel member defining a tack-nail.

5. The slide assembly of claim 1 wherein said slide assembly is formed from metal.

* * * * *